United States Patent [19]

Schwenk

[11] Patent Number: 4,512,488

[45] Date of Patent: Apr. 23, 1985

[54] SEALING TUBULATION AND METHOD

[75] Inventor: Tyrone D. Schwenk, Fallston, Md.

[73] Assignee: The United States of America as represented by the Secretary of the Army, Washington, D.C.

[21] Appl. No.: 581,451

[22] Filed: Feb. 17, 1984

Related U.S. Application Data

[63] Continuation of Ser. No. 382,505, May 27, 1982, abandoned.

[51] Int. Cl.[3] ..... H01J 9/26; H01J 19/54; H01K 3/12; H01K 1/36

[52] U.S. Cl. ..... 220/2.2; 65/34; 228/60; 445/43

[58] Field of Search ..... 215/13 R; 313/315, 317, 313/318; 65/270, 34; 141/65; 220/2.2; 206/524.8; 445/43; 228/60

[56] References Cited

U.S. PATENT DOCUMENTS

| | | | |
|---|---|---|---|
| 1,623,323 | 4/1927 | Van Voorhis | 141/65 X |
| 1,914,634 | 6/1933 | Eden et al. | 220/2.2 |
| 2,776,473 | 1/1957 | Dailey et al. | 220/2.2 X |
| 3,080,497 | 3/1963 | Noel et al. | 313/315 X |
| 3,763,390 | 10/1973 | Belknap | 313/315 |
| 3,968,195 | 7/1976 | Bishop | 156/304.2 |
| 4,385,257 | 5/1983 | Fitzgerald | 313/315 |

FOREIGN PATENT DOCUMENTS

| | | | |
|---|---|---|---|
| 1163731 | 2/1964 | Fed. Rep. of Germany | 220/2.2 |
| 784009 | 10/1957 | United Kingdom | 220/2.2 |

*Primary Examiner*—Allan N. Shoap

*Attorney, Agent, or Firm*—Anthony T. Lane; Jeremiah G. Murray; Edward Goldberg

[57] ABSTRACT

An enclosure for sealing components is sealed by a tubulation member having a narrowed cross-sectional width in one dimension. The narrowed dimension serves to minimize stresses at the tubulation interface when the enclosure is sealed by pinching the tubulation member. This allows a large tubulation member to be used and pinched-off closer than possible with a rounded tube.

8 Claims, 2 Drawing Figures

SEALING TUBULATION AND METHOD

STATEMENT OF GOVERNMENT INTEREST

The Government has rights in this invention pursuant to Contract No. DAAB07-78-C-2990 awarded by Department of the Army.

This application is a continuation of application Ser. No. 382,505, filed May 27, 1982, now abandoned.

BACKGROUND OF THE INVENTION

This invention relates to the construction of vacuum envelopes, and more particularly, to improved tubulation used in sealing a vacuum envelope.

In the production of vacuum envelopes such as those used in housing electronics components, it is common practice to braze a ductile tubulation to an exhaust passage in the wall of the envelope. This tubulation is normally a cylindrical copper or glass tube having a circular cross-section. After exhausting the envelope through the tubulation, the tubulation is pinched-off and a vacuum seal is created by the pinched walls of the tube. A similar process is used in manufacturing a gas-filled enclosure where the envelope is backfilled rather than evacuated.

In the manufacture of such vacuum envelopes, it is desirable to use as large a tubulation as possible in order to provide for greater throughput and faster vacuum pumpdown. It is also desirable to locate the point of pinch-off as close as possible to the envelope wall in order to reduce the likelihood of tubulation breakage in handling the finished envelope and to minimize the overall size of the completed package.

Problems can arise however, with the use of large bore cylindrical tubulation when the point of pinch-off is close to the point at which the tubulation is brazed to the envelope. That is, the closer the point of pinch-off in relation to the braze interface, the greater the stress on the braze during pinch-off. This stress can cause the walls of the tubulation to break away from the envelope resulting in a breakdown of the vacuum. While these stresses may be minimized through the use of small bore tubulation, this causes an increase in the time required for vacuum pumpdown. Stresses may also be minimized even for large bore tubulation by locating the point of pinch-off further away from the braze interface. However, in this case, the projecting portion of the tubulation remaining after pinch-off is more prone to breakage than one which is almost flush with the surface of the envelope. Further, this large projection is often unsuitable for use in miniature vacuum components where package size dictates the amount of acceptable projection.

SUMMARY OF THE INVENTION

The object of the invention is to allow a large bore tubulation to be pinched-off and sealed close to the surface of an envelope housing electronic components while minimizing the stresses associated with the pinch-off.

The tubulation according to the invention preferably has an oval shape with a narrowed cross-sectional width in one dimension disposed at the brazed interface. The overall cross-sectional area of the bore is unchanged from that of a round tubulation, while the amount of pinching required for the narrow dimension to achieve sealing is decreased.

DETAILED DESCRIPTION OF THE INVENTION

Figure 1:
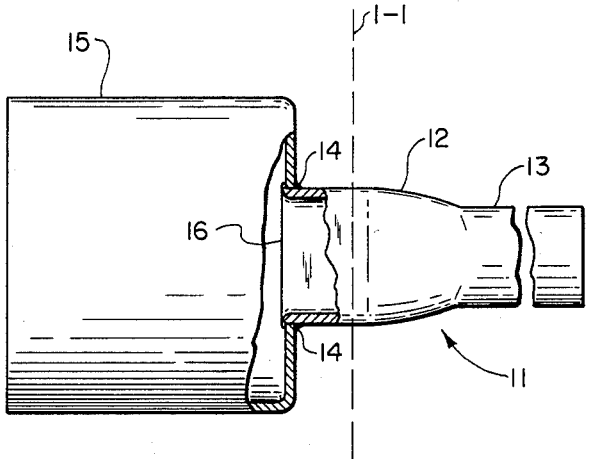
FIG. 1 is a side view in partial cross-section of a tubulation incorporating the teachings of this invention.

Referring to FIG. 1, there is shown a vacuum envelope 15, having an exhaust passage 16. A tubulation 11 is provided having an outer cylindrical tubular section 13 and a narrowed inner section 12 extending into a like-shaped exhaust passage 16 and affixed by brazing at the perimeter indicated by the braze interface 14. The shape of the narrowed section 12 is more clearly illustrated in FIG. 2 which shows an end view of the structure of FIG. 1. For the purpose of illustration only, the narrowed section of tubulation is shown to be ovalated, although any configuration having two side walls in close proximity in one dimension could be used. The tubulation 11 is made of ductile material, such as copper or glass, which can be easily pinched to form a seal.

Figure 2:
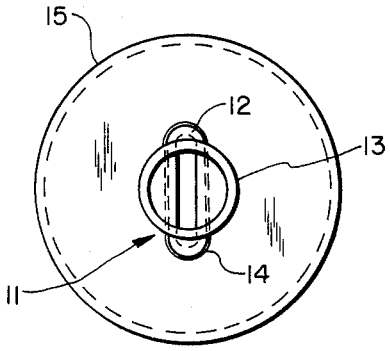
FIG. 2 is an end view of the structure of FIG. 1.

As the structure in FIGS. 1 and 2 shows, a tubulation, initially in the form of tubular section 13, is formed into an oval shape which allows a large volume of air to pass through, yet requires only slight pinching at the narrowed section 12 to close the tubulation 11 completely. The intended point of pinch-off is indicated in FIG. 1 as dashed Line 1—1. In one preferred embodiment, using cylindrical tubulation of oxygen-free copper having an outer diameter of 0.375 and an inner diameter of 0.341 inch, a narrowed portion is formed having a longer inner dimension of 0.476 inch and a shorter inner dimension between opposite closely spaced walls of 0.130 inch. The smaller dimension is preferably less than one-half the larger dimension.

The exhaust passage 16 should have substantially identical dimensions to the outer dimensions of narrowed section 12 in order to insure a proper seal. The tubulation 11 is brazed to the envelope 15 at the braze interface 14. The tubulation 11 is then attached to a vacuum system for exhausting in the case of a vacuum envelope, or backfilling in the case of a gas-filled envelope. When the exhausting or backfilling is complete, the tubulation 11 is pinched-off in a known manner in the narrowed section 12 at Line 1—1. The portion of the tubulation 11 from the tubular section 13 to the point of pinch-off may then be removed.

The method which has been described is of particular advantage in the manufacture of miniature electronics devices where overall package size may dictate that the pinch-off be as close as possible to the enclosure.

It should be understood, of course, that the foregoing disclosure relates to only a preferred embodiment of the invention and that numerous modifications or alterations may be made therein without departing from the spirit and the scope of the invention as set forth in the appended claims.

What is claimed is:

1. An enclosure for sealing components comprising:

an airtight envelope having an exhaust opening in one wall; and separate airtight tubulation means including a bore having one end sealed to the perimeter of said opening to form a passage, said opening having two opposing curved sections joined by two closely spaced sides wherein the width is narrower in one dimension than the other, said tubulation means having a like narrower width cross-section in one dimension corresponding to said opening with two opposing curved sections joined by two closely spaced sides at said one end and a round cross-section at the other end, the overall cross-sectional area of said tubulation means bore being substantially unchanged from said one end to said other end, said tubulation having an integral structure of a uniform material throughout and being adapted to be pinched off across said narrower width adjacent said one end and envelope to create a vacuum seal for said enclosure, said opening having a shape and dimensions substantially equal to said one end of said tubulation.

2. An enclosure as defined in claim 1, wherein said envelope is cylindrical and has a round cross-section and said sides of said opening and tabulation are parallel and said curved sections are rounded, and wherein said one end of said tubulation extends into said opening.

3. An enclosure as defined in claim 1, wherein said tubulation means is a ductile tube having said one end brazed to said perimeter of said opening.

4. An enclosure as defined in claim 3, wherein said tubulation is of a material from the group consisting of copper and glass.

5. An enclosure as defined in claim 1 wherein the inner dimension of said narrower cross-section at said one end is less than half the inner dimension of the larger cross-section at said one end.

6. A method of making an enclosure for sealing components comprising:

supporting an airtight envelope including components to be sealed therein, said envelope having an exhaust opening in a wall, said exhaust opening having one dimension narrower than the other dimension;

sealing to the perimeter of said exhaust opening a separate airtight tubulation member including a bore having a cross-section narrower in one dimension than the other and of substantially the same shape and dimensions at one end as said opening to form a passage and having a substantially round cross-section at the other end, said tubulation being of an integral structure and a uniform material throughout and having an overall cross-sectional area of said bore substantially unchanged from said one end to said other end;

exhausing said envelope through said tubulation member;

pinching off said tubulation member across said narrower dimension adjacent said one end and envelope to form a vacuum seal for said enclosure; and removing the portion of the tubulation member extending beyond the pinched off section.

7. The method of claim 6 wherein said envelope is cylindrical and had a round cross-section.

8. The method of claim 6 wherein said tubulation member initially has a continuous round cross-section, said one end being formed into an oval shape having said one narrower dimension.

* * * * *